US005111882A

United States Patent [19]

Tang et al.

[11] Patent Number: 5,111,882

[45] Date of Patent: May 12, 1992

[54] USE OF TRACERS TO MONITOR IN SITU MISCIBILITY OF SOLVENT IN OIL RESERVOIRS DURING EOR

[75] Inventors: Joseph S. Tang; Bradford C. Harker, both of Calgary, Canada

[73] Assignee: Exxon Production Research Company, Houston, Tex.

[21] Appl. No.: 711,284

[22] Filed: Jun. 6, 1991

[51] Int. Cl.[5] ..... E21B 49/00; E21B 43/22

[52] U.S. Cl. ..... 166/252; 166/250; 436/27; 436/56

[58] Field of Search ..... 166/250, 252, 266, 268; 73/155; 436/27, 28, 29, 56

[56] References Cited

U.S. PATENT DOCUMENTS

| | | | |
|---|---|---|---|
| 3,008,521 | 11/1961 | Boucher | 166/250 |
| 3,231,018 | 1/1966 | Handy | 166/252 |
| 3,333,631 | 8/1967 | Heller | 166/252 |
| 3,847,548 | 11/1974 | Keller et al. | 166/252 X |
| 3,894,584 | 7/1975 | Fertl | 166/252 X |
| 4,223,727 | 9/1980 | Sustek, Jr. et al. | 166/250 |
| 4,725,551 | 2/1988 | Thompson | 436/56 X |
| 4,742,873 | 5/1988 | Craig, III | 166/252 |

*Primary Examiner*—George A. Suchfield

*Attorney, Agent, or Firm*—Pravel, Gambrell, Hewitt, Kimball & Krieger

[57] ABSTRACT

A method for monitoring in situ miscibility of a solvent with reservoir oil by using at least two tracers having different boiling points and being miscible with the solvent. The tracers are mixed with the solvent, injected into a well and produced from another well. Appropriate analysis of the produced tracers will reveal whether the solvent is first contact miscible. The tracers are selected from the group consisting of halocarbons, halohydrocarbons, sulfur hexafluoride, tritiated or carbon 14 tagged hydrocarbons, tritium gas and radioactive isotopes of inert gases.

6 Claims, 3 Drawing Sheets

USE OF TRACERS TO MONITOR IN SITU MISCIBILITY OF SOLVENT IN OIL RESERVOIRS DURING EOR

FIELD OF THE INVENTION

The present invention relates to a method of using tracers to determine the in situ miscibility of oil reservoirs. More specifically, the present invention relates to a method for determining the degree of in situ miscibility of a solvent with subterranean reservoir oil in miscible enhanced oil recovery projects by observing the chromatographic separation of two or more tracers having different vapor pressures.

BACKGROUND OF THE INVENTION

Enhanced oil recovery operations are becoming increasingly more popular as reservoirs age and oil production declines. Waterflooding is by far the most widely used method, but it is sometimes economical to inject other fluids, such as hydrocarbon solvents, into a partially depleted oil field in an effort to recover oil which was not produced with waterflooding. When a solvent is used in an enhanced oil recovery operation, it is injected into the reservoir as a fluid which is miscible with the reservoir oil. This class of enhanced oil recovery is commonly known as a miscible flood because a miscible solvent is injected into the reservoir to mobilize and push the oil out of the reservoir.

Two different miscibility conditions can develop, depending on the solvent used and the reservoir conditions. The simplest and most direct method for achieving miscible displacement is to inject a solvent which completely mixes with the oil in all proportions when it first contacts the oil. This type of method produces mixtures of the solvent and oil in a single phase, and it is commonly called first contact miscible flooding. $CO_2$, $N_2$ and hydrocarbons of intermediate molecular weight, such as ethane propane, butane, or mixtures of LPG, are solvents that have been used most often for first contact miscible flooding.

If an operation uses a solvent which is not completely dissolved in the oil upon first contact, it is known as multiple contact miscible flooding. Since first contact miscible displacement is more effective than multiple contact miscible displacement in recovering oil, it is important to select a solvent composition to ensure the existence of first contact miscible conditions throughout the displacement process. The solvent composition and pressure necessary for miscibility can be determined from calculations, but constructing the necessary pseudoternary diagrams is time consuming and difficult to obtain experimentally.

In principle, the first contact miscible conditions can be determined by calculating vapor/liquid equilibria with appropriate equations of state or K-value correlations while concurrently mathematically simulating the multiple contacting and in situ mass transfer of components. However, this approach has several disadvantages. First, equations of state and K-value correlations are usually not sufficiently accurate in the region of interest. Therefore, the calibration of the correlations or equations of state must be made with the aid of experimental phase behavior data.

Another approach is to use available correlations of experimental miscibility data. However, some of these correlations are seriously in error, perhaps by 1000 psi or more. Correlations may be useful for purposes of screening reservoirs for suitability of miscible processes, but unless there is a large margin in operating pressure to allow for potential errors in the correlation estimates, miscibility pressure should be determined experimentally.

Flow experiments are preferred over calculations as a method for determining miscibility conditions. Selection of solvent composition and miscibility pressure is usually done in the laboratory using any one of a number of displacement techniques, e.g., slim-tube tests. Criteria for interpreting the displacements have included breakthrough and ultimate recoveries at a given volume of solvent injection, visual observations of core effluent, composition of produced gases, shape of the breakthrough and ultimate recovery curves vs. pressure, or combinations of these criteria. The different experimental techniques and interpretation criteria have led to vastly different conclusions.

Steps have been taken to increase the accuracy and precision of the experimental determinations. However, regardless of how accurate the laboratory work is, there is always a question as to whether the solvent determined to be first contact miscible in the laboratory will be first contact miscible with the oil in the reservoir. Since an accurate solvent design is essential to the success of an enhanced oil recovery project, it is highly desirable to use a technique which can monitor the miscibility in situ, i.e., in the reservoir, rather than in the laboratory.

Present in situ techniques for monitoring miscibility include the sampling and analysis of the produced hydrocarbon and gas. The process is determined to be first contact miscible if the gas/oil ratio and the compositions of the produced gas and hydrocarbon can be represented as a linear combination of reservoir oil and solvent. However, measurement errors in the gas/oil ratio and oil and gas compositions, combined with the inadequacy of the equations of state, make the results of this "recombination" technique inaccurate and ambiguous. In addition, this technique is not sufficiently sensitive to small changes in produced fluid properties, such as those which arise when the solvent and reservoir oil are slightly immiscible.

Other factors contribute to the inaccuracy of the "recombination" technique. The recombined reservoir oil may not truly represent the actual reservoir oil because of either improper sampling or the great variability of the oil and gas properties throughout the reservoir. This variability is particularly pronounced in reservoirs which had previously produced for an extended period of time by solution gas drive at below bubble point pressure followed by waterflooding in order to increase the reservoir pressure in preparation for the enhanced oil recovery project. When producing at below bubble point pressure for extended periods of time, the gas saturation, gas/oil ratio, and oil properties will be heterogeneous through the reservoir because of the vast differences in mobilities of gas and oil. Even where the reservoir is later pressurized above the bubble point, pockets of free gas will remain because the gas is slow to dissolve into the oil.

Consequently, there is still a need in the industry for an accurate method to monitor miscibility of a solvent in a miscible flood operation. The present invention, which is a direct, in situ method of monitoring miscibility fulfills this need because it is accurate and highly sensitive, and it requires simple and dependable data interpretation.

SUMMARY OF THE INVENTION

The present invention relates to a process in which the miscibility of a solvent in reservoir oil in a hydrocarbon-containing formation is determined by injecting a fluid containing at least two properly selected tracers into the formation. The tracers are selected from the group consisting of halocarbons, halo-hydrocarbons, tritiated or carbon 14 tagged hydrocarbons, sulfur hexafluoride, tritium gas and radioactive isotopes of inert gases. The tracers must have different vapor pressures and preferentially partition into the oil phase and gas phase, if both phases exist. Preferred tracers useful in this invention are sulfur hexafluoride, tritiated methane and tritiated heptane. The presence and amounts of the tracers are detected at a production well in another location. The boiling points of the tracers should be at least 50° F. apart, preferably 200° F. or above, to provide detectable separation of the tracers.

DESCRIPTION OF THE INVENTION

Figure 1:
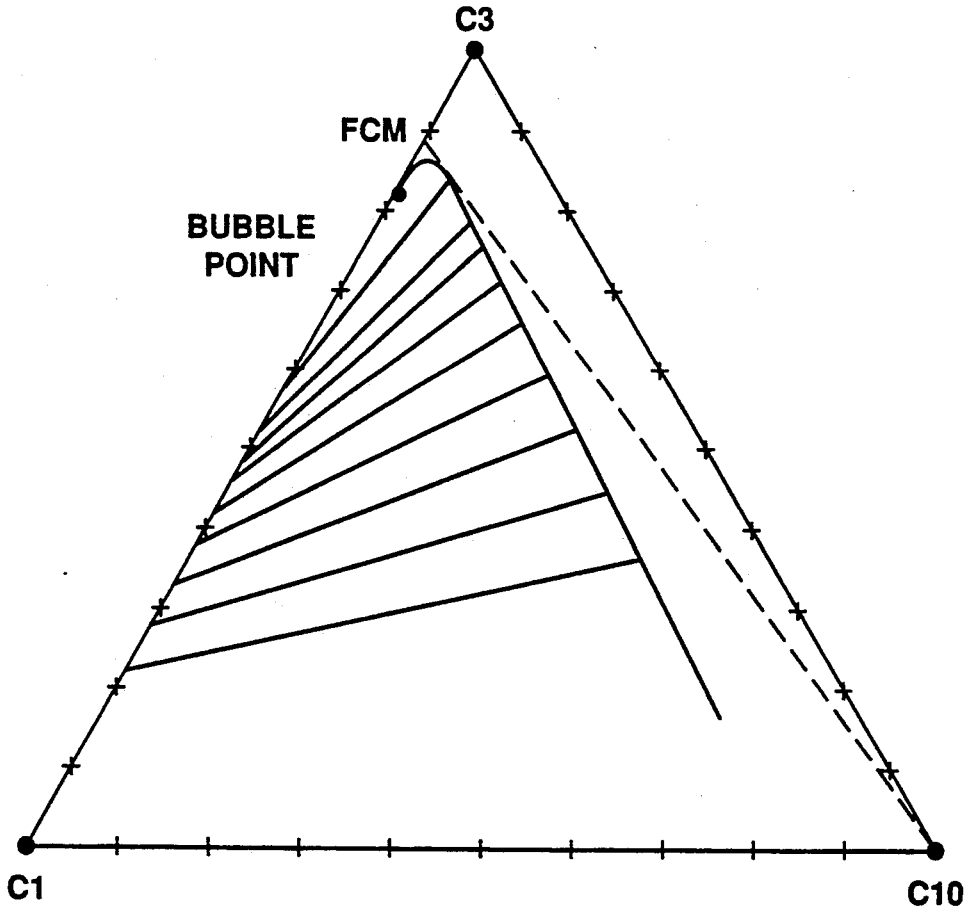
FIG. 1 is a ternary diagram showing the miscibility of the C1/C3/C10 system used in Examples 1, 2 and 3.

In this invention, a mixture of tracers is injected with the solvent as a slug or continuously at any stage in a miscible flood project. The tracers are later produced from production wells in the vicinity of the injection well. The tracers consist of at least two compounds selected from the following groups: halo-hydrocarbons, halocarbons, sulfur hexafluoride, tritiated or carbon 14 tagged hydrocarbons, tritium gas and radioactive isotopes of inert gases.

The tracers must be miscible with the solvent so that the solvent and tracers can be injected into the reservoir in a single phase. The tracers selected must also have different boiling points and should have a difference of at least 50° F. in their boiling points, and preferably at least 200° F. In the preferred embodiment of this invention, tracers can be selected so that the tracer separation test can be completely eliminated by selecting one low boiling point and one high boiling point tracer, e.g., −100° F. and 200° F., respectively. The low boiling point tracer will be produced predominantly with the gas phase, while the high boiling point tracer will be produced predominantly with the oil phase. The tracers selected should also be detectable at the parts per million level by appropriate analytical means in order to be economically feasible.

The produced tracers may be found in the produced gas, in the produced oil, or in both, depending on the vapor pressure of the tracers and the separator condition. The produced tracers in the gas and oil phases are separated and analyzed. Analysis of the halo-hydrocarbons, halocarbons and sulfur hexafluoride is usually by gas chromatography equipped with an electron capture detector. Tritiated or carbon 14tagged hydrocarbons (including tritium gas) can be measured using liquid scintillation counter and gas proportional counter.

The various tracers which can be used in practicing this invention are partitioning tracers. Wherever the gas phase and oil phase coexist in a reservoir, the tracers will distribute themselves between these phases, according to the tracer's K-values or Henry's law constants. When passing through a reservoir having both an oil and a gas phase, the tracer with a low boiling point (high vapor pressure) will be produced in the gas stream ahead of the high boiling point (low vapor pressure) tracer. When this occurs, a distinct separation of the tracers will be observed.

If the displacement solvent is first contact miscible, there should be only one phase throughout the reservoir. In this case, separation of the tracers would be impossible, and the tracers would have the same scaled production functions. By contrast, if the solvent is not first contact miscible with the reservoir oil, a two-phase zone will develop. The size of the two-phase zone will be directly related to the miscibility of the solvent with the oil. The tracers will separate and partition in the two-phase zone.

The tracer separation in the two-phase zone is extremely sensitive to the miscibility condition of the solvent with the reservoir oil. Even slight deviations from the first contact miscible condition results in a significant tracer separation. The tracer separation is thus a highly useful miscibility indicator, with the degree of separation being directly related to the size of the immiscible zone which is, in turn, directly related to the deviation from first contact miscibility.

The following examples are for illustrative purposes only and are not intended to limit the scope of this invention:

EXAMPLES

Four examples were performed One was conducted in situ. The others were conducted in the laboratory using a slim-tube with various mixtures of methane (C1) and propane (C3) as the solvent and decane (C10) as the oil. The ternary diagram for the C1/C3/C10 system at 610 psig and 50° C is shown in FIG. 1. Solvent leaner than 18% C1 was below bubble point at the above pressure and temperature. Hence, the solvent could not be richer in C1 than 18%. The solvent composition corresponding to the first contact miscible condition was approximately 10% C1 and 90% C3. The slim-tube was first saturated with C10 (simulated oil). Solvent made up of a mixture of C1 and C3 was then injected to displace C10. The solvent was spiked with three tracers—sulfur hexafluoride (SF6), bromo-trifluoro-methane (F13B1), and dichloro-difluoro-methane (F12). The tracer concentrations in the produced gas were measured by a gas chromatograph with an electron capture detector.

EXAMPLE 1

Figure 2:
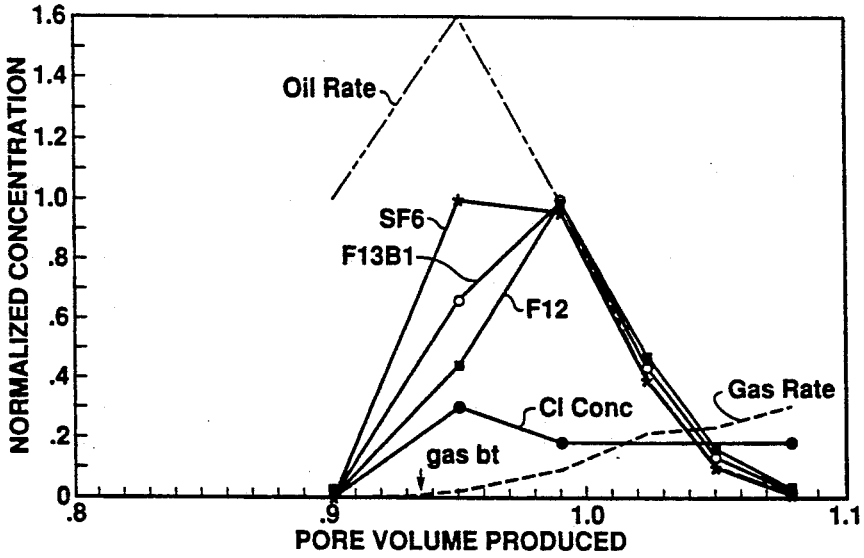
FIG. 2 is the tracer production curves for Example 1.

The solvent used had a composition of 15% C1 and 85% C3. This corresponds to a condition just slightly more immiscible than first contact miscible. As shown in FIG. 2, the tracers broke through at nearly the same time. SF6, which has the highest vapor pressure of the three tracers, was produced first, followed by F13B1 and F12. There was little separation of F13B1 and F12, probably due to the very small immiscible zone which developed during the test.

EXAMPLE 2

Figure 3:
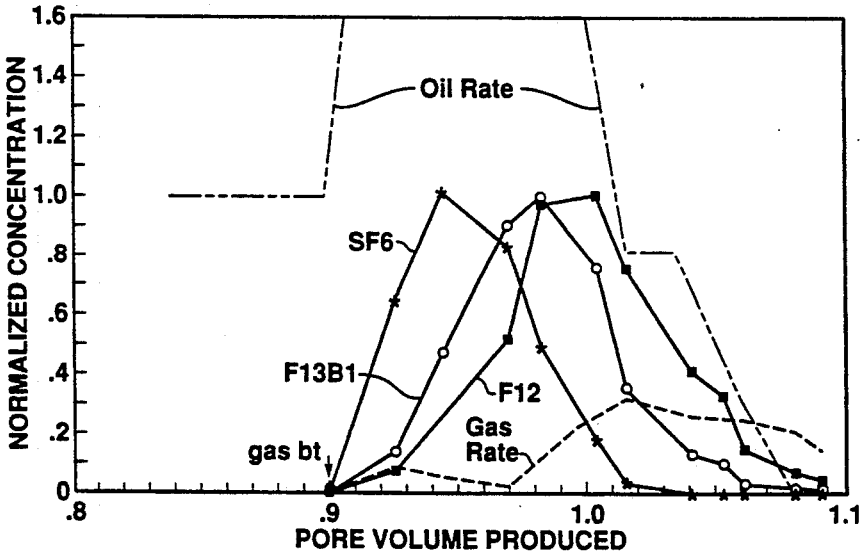
FIG. 3 is the tracer production curves for Example 2.

This test was run at more immiscible conditions with a leaner solvent. The solvent used had a concentration of 17% C1 and 83% C3. Because a bigger immiscible zone formed, the tracers were widely separated, as shown in FIG. 3.

EXAMPLE 3

Figure 4:
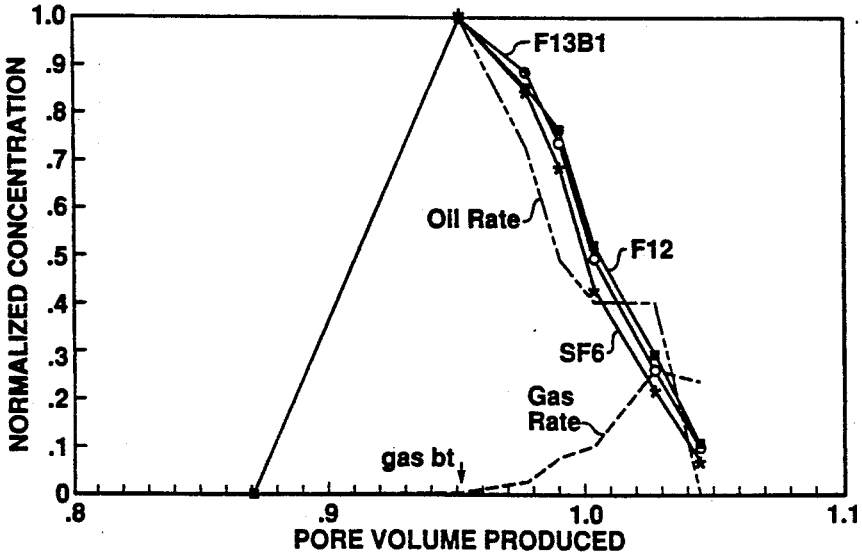
FIG. 4 is the tracer production curves for Example 3.
Figure 5A:
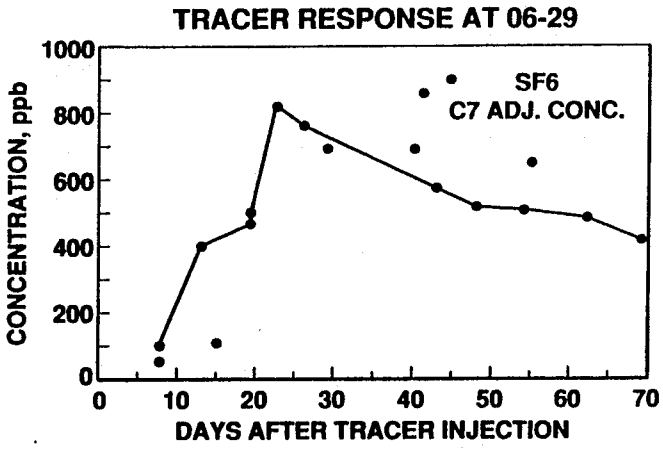
FIG. 5 is the tracer production curves for the four production wells used in Example 4.
Figure 5B:
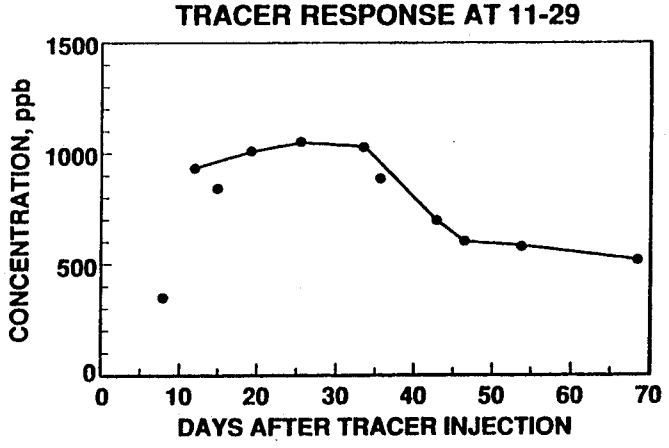
Figure 5C:
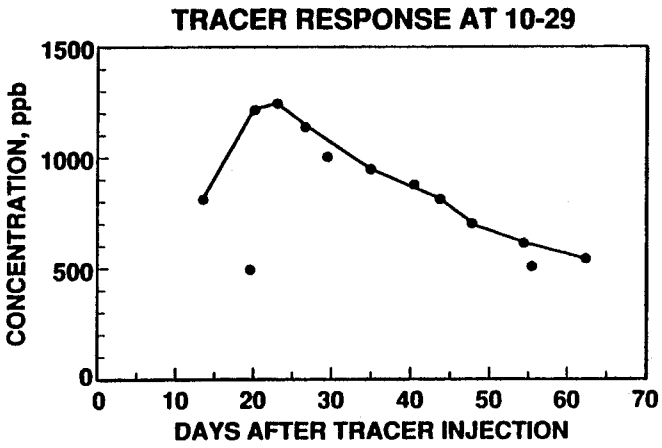
Figure 5D:
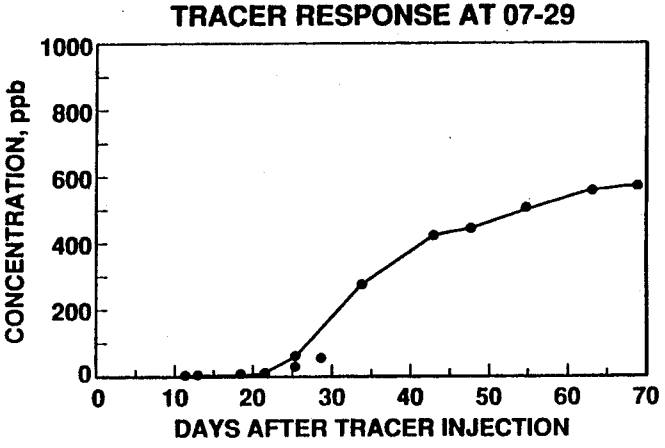

This test was run at first contact miscible condition using the same solvent composition as in Example 2 but at an elevated pressure of 800 psig. In sharp contrast with Example 2 (FIG. 3), there was no tracer separation, as shown in FIG. 4.

EXAMPLE 4

The invention was applied to a solvent miscible pilot project in a carbonate oil reservoir. The test was performed by injecting into the center injector of a five-spot pattern a slug of tracers containing sulfur hexafluoride, tritiated methane and tritiated heptane. Production from the four producers was analyzed for the three tracers. The tracer production data for the four producing wells are shown in FIG. 5, which shows that sulfur hexafluoride and tritiated heptane tracked each other closely. The absence of a separation between the sulfur hexafluoride (sublimation temperature −82.8° F.) and the tritiated heptane (boiling point 209° F.) indicates that the solvent was first contact miscible in the reservoir oil. The tritiated methane response was spurious and was not included in FIG. 5.

It should be noted that the recoveries for Examples 1, 2, and 3 were all above 98% at one pore volume of solvent injection. From the recoveries, it would appear that all three tests are essentially first contact miscible. However, the vast differences in the production curves in the three tests clearly reveal the presence of three distinct miscibility conditions. Therefore, the tracer separation obtained in practicing this invention is a more sensitive and reliable indicator than the commonly used miscibility criteria based on fractional recovery at one pore volume injection.

Flow tests are often performed on miscible enhanced oil recovery projects. These tests consist of injecting and producing solvent tagged with a single tracer in an effort to gain information on channelling, communication, and solvent distribution. Implementation of this invention would simply require the inclusion of a second tracer in one of the flow tests and would provide highly useful miscibility information for very slight incremental cost.

The principle of the invention, a detailed description of one specific application of the principle, and the best mode in which it is contemplated to apply that principle have been described. It is to be understood that the foregoing is illustrative only and that other means and techniques can be employed without departing from the true scope of the invention defined in the following claims.

We claim:

1. A method for monitoring in situ miscibility of a solvent with reservoir oil, comprising,
   - selecting at least two tracers from the group consisting of halo-hydrocarbons, halocarbons, sulfur hexafluoride, tritium gas, radioactive isotopes of inert gases, and tritiated or carbon 14tagged hydrocarbons, said tracers being miscible with the solvent and having different boiling points;
   - forming a mixture comprising said tracers and said solvent;
   - injecting said mixture into an injection well;
   - producing fluids from a production well in communication with said injection well; and
   - analyzing said fluids for the presence of said tracers to determine solvent miscibility with the reservoir oil.

2. The method of claim 1 wherein the boiling point of the first tracer is at least 50° F. higher than the boiling point of the second tracer.

3. The method of claim 2 wherein the boiling point of the first tracer is at least 200° F. higher than the boiling point of the second tracer.

4. The method of claim 1 wherein one of the tracers is sulfur hexafluoride.

5. The method of claim 1 wherein one of the tracers is bromo-trifluoro-methane.

6. The method of claim 1 wherein one of the tracers is dichloro-difluoro-methane

* * * * *